United States Patent [19]

Landes

[11] Patent Number: 4,953,674

[45] Date of Patent: Sep. 4, 1990

[54] GARMENT BAG APPARATUS

[76] Inventor: Scott D. Landes, 9906 Kell Ave. S., Bloomington, Minn. 55437

[21] Appl. No.: 433,281

[22] Filed: Nov. 8, 1989

[51] Int. Cl.[5] ..... A45C 3/08; A45C 13/10; A45C 13/22; A45C 13/38

[52] U.S. Cl. ..... 190/108; 190/26; 190/102; 150/105; 150/154; 383/111

[58] Field of Search ..... 190/26, 40, 100, 125, 190/102, 108; 150/100, 103–105, 127, 154; 383/111

[56] References Cited

U.S. PATENT DOCUMENTS

| | | | |
|---|---|---|---|
| 1,522,479 | 1/1925 | Aldrich | 190/26 X |
| 1,526,839 | 2/1925 | Dempsey | 190/26 |
| 1,915,007 | 6/1933 | Weiss | 190/109 X |
| 2,067,851 | 1/1937 | Lifton | 190/109 |
| 2,432,365 | 12/1947 | Allen | 190/26 X |
| 2,436,237 | 2/1948 | Brandt | 150/154 |
| 2,532,154 | 11/1950 | Duskin | 190/26 |
| 2,617,504 | 11/1952 | Meyers | 190/26 |
| 2,674,288 | 4/1954 | Laidlaw | 190/109 X |
| 2,732,046 | 1/1956 | Smallberg | 190/26 |
| 3,349,992 | 10/1967 | Skinner | 150/154 |
| 3,433,335 | 3/1969 | Spitz | 190/109 X |
| 3,613,843 | 10/1917 | Davis | 190/109 X |
| 3,901,360 | 8/1975 | Cook | 190/26 |
| 3,963,102 | 6/1976 | Carp | 190/110 X |
| 4,026,339 | 5/1977 | Burke | 383/111 X |
| 4,657,135 | 4/1987 | Kjose | 190/26 X |
| 4,716,947 | 1/1988 | Maddock | 190/26 X |

FOREIGN PATENT DOCUMENTS

| | | | |
|---|---|---|---|
| 476985 | 9/1951 | Canada | 150/154 |
| 1532842 | 7/1969 | Fed. Rep. of Germany | 150/154 |
| 1021817 | 2/1953 | France | 150/103 |
| 1038915 | 10/1953 | France | 150/154 |
| 1059597 | 3/1954 | France | 383/111 |
| 2147497 | 5/1985 | United Kingdom | 190/100 |
| 2167656 | 6/1986 | United Kingdom | 190/26 |

*Primary Examiner*—Sue A. Weaver
*Attorney, Agent, or Firm*—Jacobson & Johnson

[57] ABSTRACT

A garment bag apparatus including a pouch for storing a collapsible garment bag carrier when not in use and a garment bag carrier storable within the pouch when not in use with the garment bag carrier including an interior compartment to hold miscellaneous items and a folded garment bag with the garment bag carrier including openings to permit the straps and handles of the garment bag to be extended through the openings so the traveler can carry the garment bag in a conventional manner. Closures on the garment bag carrier permit the handles and strap of the garment bag to be inserted into the garment bag carrier to permit the garment bag carrier to be used like a conventional suitcase when transferring the garment bag carrier from one destination to another.

8 Claims, 2 Drawing Sheets

GARMENT BAG APPARATUS

FIELD OF THE INVENTION

This invention relates generally to luggage and, more specifically, to a storable garment bag carrier that is a combination luggage bag and protective covering for a garment bag to protect the garment bag during handling as well as permit a traveler to carry the garment bag using the handles on the garment bag.

BACKGGROUND OF THE INVENTION

The concept of garment bags is old in the art. Typically, a garment bag comprises an elongated, flexible, foldable bag having a zipper along the edges and a hook on one end. The garment bags usually fold at the middle of the bag with handles such as a handgrip and a shoulder strap located at the fold. The handles permit the traveler to carry the garment bag like a suitcase. One end of the garment bag usually contains a hook so that when the user arrives at his or her destination the user can unfold and hang the garment bag on a clothes rod. Usually, the garment bags are made of lightweight material and are intended to be carried by the traveler. One of the problems with checking garment bags at airports is that the garment bags receive substantial abuse from the handlers and the equipment. This is particularly true in airports where the garment bags must be handled many times before the garment bag arrives at the travelers destination. Oftentimes the garment bag hook will be ripped off or the handles may be torn loose. Still other times grease or dirt may get on the garment bag. Since the garment bag is usually hung up in a closet a person can get grease or dirt on clothes that are hung next to the garment bag. The present invention solves the problem of garment bag damage or soiling due to handling and transportation as well as provides additional carrying space to permit the user to stow away last minute items.

DESCRIPTION OF THE PRIOR ART

The Weiss U.S. Pat. No. 1,915,007 shows a collapsible toilet kit that has a zipper along the edges. The kit is used for holding articles in an upright position within the interior of the container.

The Lifton U.S. Pat. No. 2,067,851 shows a correspondent's case with a zippered closure to permit insertion of documents and the like.

The Brandt U.S. Pat. No. 2,436,237 shows a removable cover for handbags or similar articles that protects handbags, hats, and other articles from rain, dust, or wear. The bag contains different buttonholes and sizes to enable a user to adjust the envelope to the different size and shape of articles and bags.

The Laidlaw U.S. Pat. No. 2,674,288 shows a portfolio for holding documents within the portfolio with a zipper located around the edge of the portfolio.

The Skinner U.S. Pat. No. 3,349,992 shows a flexible shopping bag cover for placing over the shopping bag to provide the closure for the shopping bag.

The Davis U.S. Pat. No. 3,613,843 shows a centerfold twin compartment travel bag that has supports for operating as a standing travel bag.

The Spitz U.S. Pat. No. 3,433,335 shows a conventional travel bag for holding garments in an upright position. The bag can be folded to a more convenient suitcase size.

The Carp U.S. Pat. No. 3,963,102 shows carryon luggage bag with a tote bag and cluth bag nested within the carryon luggage bag.

The Canadian Patent No. 476,985 shows an elastic stretchable cover for snugly enclosing an article of the luggage.

BRIEF SUMMARY OF THE INVENTION

Briefly, the present invention comprises a pouch for storing a collapsible garment bag carrier when not in use and a garment bag carrier that includes an interior compartment to hold miscellaneous items and a folded garment bag. The garment bag carrier includes openings to permit the straps and handles of a garment bag to be extended through the openings so the traveler can carry a garment bag in a conventional suitcase like manner. Closures on the garment bag carrier permit the handles and strap of the garment bag to be inserted into the garment bag carrier. The handles located on the exterior of the garment bag carrier permit the garment bag carrier to be used like a conventional suitcase when checking in a garment bag. The garment bag carrier interior compartment is sufficiently large so to permit the traveler to store miscellaneous items alongside the garment bag.

DESCRIPTION OF THE PREFERRED EMBODIMENT

Figure 1:
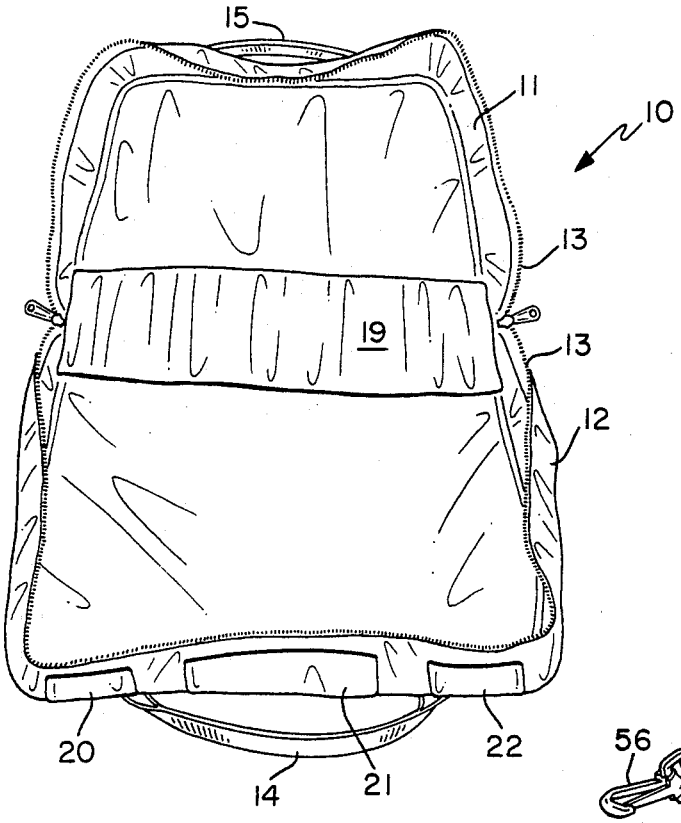
FIG. 1 shows my garment bag carrier in an open view.
Figure 2:
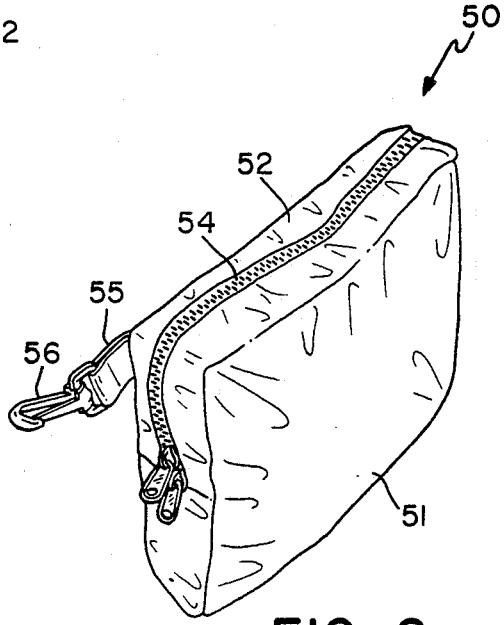
FIG. 2 shows a pouch carrying case for my garment bag carrier.

FIG. 1 and FIG. 2 show my garment bag apparatus to comprise a garment bag carrier 10 and a pouch 50 for storing my garment bag carrier when it is not in use.

Referring to FIG. 1 reference numeral 10 generally designates my garment bag carrier comprising a first rectangular shaped shell member 11 that mates with a similar rectangular shaped shell member 12 through a zipper 13. Typically, shell members 11 and 12 are made from heavy duty corduva nylon or the like so as to be flexible and collapsible for storage purposes. The use of a material like nylon or the like also protects the garment bag and other items in the garment bag carrier from rain, snow, or unknown machines that the garment bag carrier may encounter during transfer from one destination to another. Located in the bottom of the garment bag carrier 10 is a waterproof bottom 19 that prevents water from soaking through and getting the garment bag and clothes wet. Located on top of the garment bag 10 are a set of three flap closures 20, 21 and 22 and a pair of handles 14 and 15 to permit a traveler to carry the garment bag carrier as a conventional piece of luggage.

FIG. 2 shows my pouch for storing my collapsible garment bag carrier when the garment bag carrier is not in use. Pouch 50 comprises a flexible shell 51 and a flexible shell 52 having a zipper 54 connecting shell 51 and 52 to each other. A strap 55 with a snap-hook 56 attaches to pouch 50 to permit a traveler to carry the pouch with the garment bag carrier by attaching snap 56 of the pouch to the handle of a garment bag. Typically, pouch 50 is made of a flexible material such as a lightweight nylon.

Figure 6:
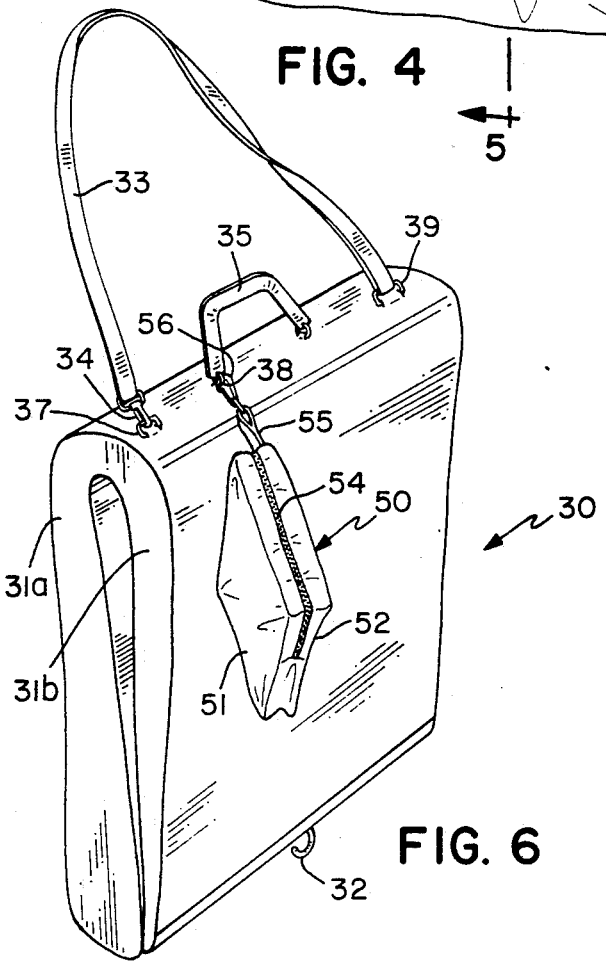
FIG. 6 is a pictorial view of a conventional garment bag.

FIG. 6 shows a conventional garment bag 30 with a shoulder strap 33. One end of strap 33 connects to bag 30 through a ring 39. The other end of strap 33 connects to garment bag 30 with a snap 34 that connects to ring 37. FIG. 6 also illustrates a conventional garment bag 30 in the folded condition so that sides 31*a* and 31*b* form a generally U-shape. Located on the bottom of garment bag 30 is a conventional hook 32. Located in the top center of garment bag 30 is a handle 35 to permit the traveler to carry garment bag 30 like a conventional suitcase.

To illustrate how my garment bag apparatus can be carrier about by the traveler without being used reference should be made to FIG. 6. Located attached to handle 35 is pouch 50 which is attached to ring 38 on handle 35 with pouch snap 56. Thus the present invention permits the traveler to carry my folding garment bag carrier in a small pouch that can be attached or detached to a garment bag.

Figure 3:
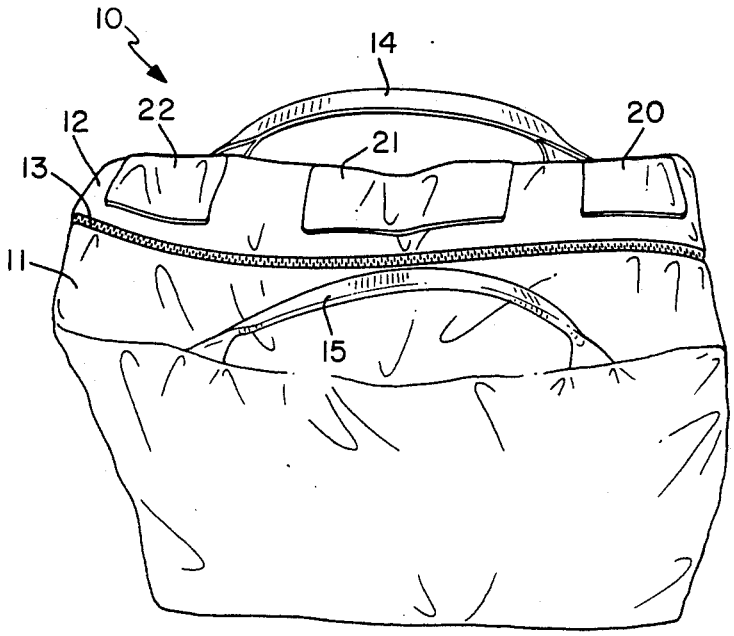
FIG. 3 shows my garment bag in a closed condition.
Figure 4:
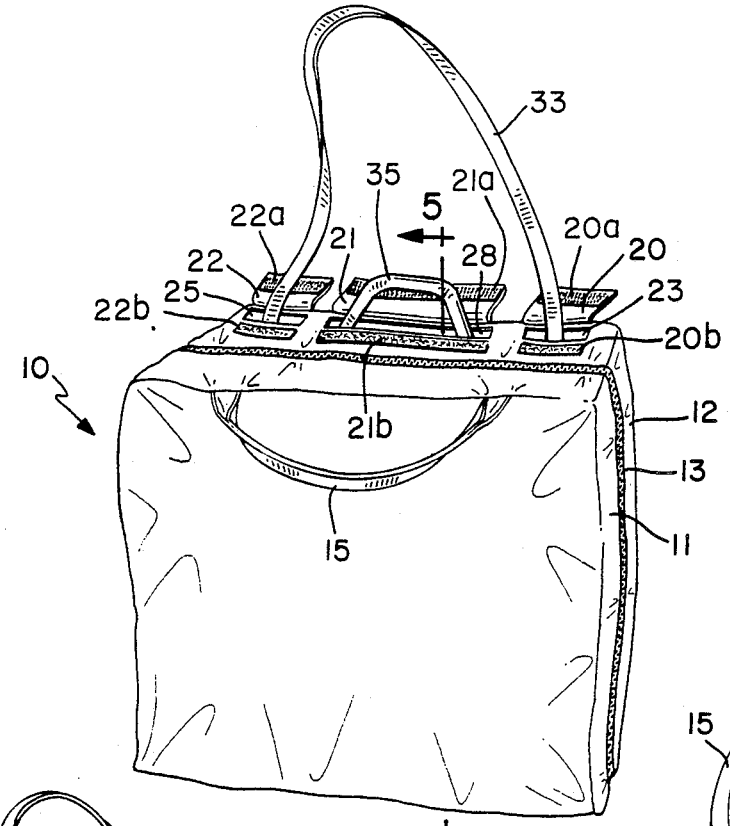
FIG. 4 shows my garment bag carrier with the flaps open to expose the carrying handles on the interior garment bag carrier.
Figure 5:
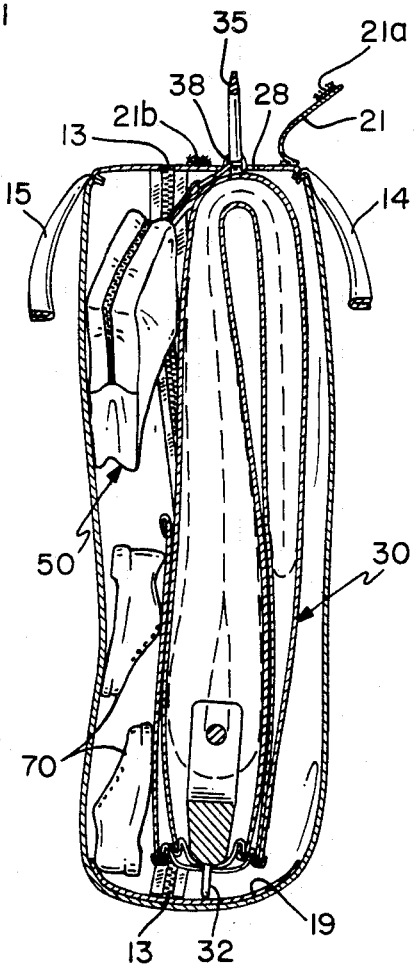
FIG. 5 is a section view taken along lines 5—5 of FIG. 4.

In order to appreciate the operation of my invention as a garment bag carrier and travel bag, reference should be made to FIGS. 3, 4, and 5. FIG. 3 shows my garment bag carrier containing a garment bag and in the condition for handling during transfer between destinations. Note the garment bag is completely contained within the garment bag carrier so that no hooks or straps of the garment bag are exposed.

FIG. 4 illustrates how my garment bag carrier permits a traveler to carry both the garment bag and the garment bag carrier using the conventional straps or handle on the garment bag. Located on one end of garment bag carrier 10 is an opening 25 for one end of strap 33. Located on one side of opening 25 is a Velcro strip 22*b* and located on the other side is a flap 22 with a Velcro strip 22*a* for engaging Velcro strip 22*b*. Similarly, located on the other end of garment bag carrier 10 is an opening 23 for strap 33. Located on one side of openings 23, is a Velcro strip 20*b* and located on the opposite side is a flap 20 with Velcro strip 20*a* for engaging Velcro strip 20*b*. Located in the center of the garment bag carrier 10 is another opening 28 for handle 35. Located next to opening 28 is a Velcro strip 21*b* and located on the opposite side is a flap 21 with Velcro strip 21*a* for engaging Velcro strip 21*b*. Flaps 20, 21, and 22 can be opened or closed by the user.

FIG. 5 illustrates the feature of the invention with the garment bag located in the garment bag carrier. Note that the garment bag carrier has an interior compartment that is sufficiently large so that it easily accommodates the entire folded garment bag as well as provides additional space for pouch 50 or additional items such as shoes 70 or the like. Thus not only does the garment bag carrier protect the garment bag, it also provides a compartment for the traveler to place items in just before checking the garment bag carrier. For example, the traveler may have an extra pair of shoes, gloves, or other small items that the traveler does not want to carry with but wants to have available when the garment bag carrier is picked up at the travelers destination. The traveler can insert the items into the garment bag carrier by opening zipper 13. Once the last minute items are stored along with the garment bag the traveler hands the zippered garment bag carrier to the check in attendant to transfer the garment bag carrier and it's contents to the travelers destination.

The ability to place the straps or handgrip of the garment bag through the openings in the garment bag carrier permits the traveler to carry the garment bag with the clothes contained therein in a flat folded condition. Consequently, the clothes hung within the garment bag receive the minimum amount of wrinkling. Also since the garment bag carrier has a general elongated shape as shown in FIG. 4 it is difficult to stand on end which would cause the clothes to bunch up at one end of the garment bag. Consequently, the garment bag carrier with it's contents is transferred from one location to another with the garment bag carrier lying on one side which minimizes the wrinkling of clothes in the garment bag.

I claim:

1. A garment bag apparatus for an airline traveler that permits the traveler to use a collapsible garment bag carrier to protect a garment bag during transfer of the garment bag from one airport to another airport with the garment bag carrier sufficiently large so as to both protect the garment bag and to stow items before checking the garment bag apparatus at an airlines comprising:

a first shell of flexible material, said first shell having at least three edges;

a second shell of flexible material, said second shell having at least three edges, said first shell connected to said second shell to permit a user fold said first shell against said second shell, said first shell and said second shell having a first opening, a second opening, and a third opening;

closure means connecting said first shell to said second shell to permit a user to temporarily fasten said first shell to said second shell to define a compartment therebetween, said compartment sufficiently large so as to separately and in a side by side relationship contain the garment bag and miscellaneous traveler items, said first shell, said second shell, and said closure means defining the collapsible garment bag carrier;

a handle connected to said first shell to permit a user to carry said first shell and said second shell;

a first flap located over the first opening in one of said shells, said first flap having closure means to permit a user to open said first flap and extend a shoulder strap of the garment bag through the first opening;

a second flap located over the second opening in one of said shells, said second flap having closure means to permit a user to open said second flap and extend the shoulder strap of the garment bag through said second opening so that a traveler can carry the garment bag located in said first shell and said second shell with the shoulder strap of the garment bag, said first flap and said second flap operable for closing to permit a traveler to stow the shoulder strap of the garment bag during the transfer of the garment bag between airport terminals;

a third flap extending over the third opening, said third flap located between said first flap and said second flap to permit a user to extend a handgrip of the garment bag through the third opening to permit a traveler to carry the garment bag located in said shells by either the shoulder strap of the garment bag or the handgrip of a garment bag said first flap, said second flap and said third flap completely operable for closing over the said openings to protect shoulder strap and handgrip during airport handling of the garment bag, and a pouch, said pouch made of a flexible material, said pouch having a compartment sufficiently large to nest the collapsible garment bag carrier therein when the collapsible garment bag carrieer is in a collapsed condition, said pouch including a fastener to permit a traveler to temporarily attach said pouch to the garment bag if the traveler does not want to use the collapsible garment bag carrier.

2. The garment bag apparatus of claim 1 wherein said garment bag carrier is made of heavy duty nylon.

3. The garment bag apparatus of claim 2 wherein said garment bag carrier has a double reinforced water proof bottom.

4. The garment bag apparatus of claim 3 wherein said garment bag carrier includes at least two handles.

5. The garment bag apparatus of claim 4 wherein said closure means connecting said first shell to said second shell comprises a zipper.

6. The garment bag apparatus of claim 5 wherein said zipper extends along three edges of said first shell.

7. A collapsible garment bag carrier for an airline traveler that permits the traveler to protect a garment bag during transfer of the garment bag from one airport to another airport and to stow items before checking the garment bag carrier at an airlines comprising:

a pair of flexible shells, said flexible shells defining a compartment that is sufficiently large to separately and in a side by side relationship hold the garment bag and miscellaneous items to thereby provide the collapsible garment bag carrier;

a flexible closure means connected to said pair of flexible shells to permit a traveler to place the garment bag and miscellaneous items in the compartment;

a handle connected to said pair of flexible shells to permit a user to carry said garment bag carrier with the garment bag located in said compartment to thereby minimize wrinkling of clothes contained in the garment bag; and an opening located in said flexible shells with a closure for completely covering said opening, said opening permitting a traveler to extend a carrying grip from the garment bag through said opening to thereby permit a traveler to carry the garment bag by either the carrying grip on the garment bag or said handle on said garment bag carrier and said closure for covering said opening operable for closing over the grip of the garment bag to protect the grip of the garment bag during airport handling of the garment bag.

8. The garment bag carrier of claim 7 including a pouch, said pouch made of a flexible material, said pouch having a compartment sufficiently large to store the collapsible garment bag carrier therein when the collapsible garment bag carrier is in a collapsed condition, said pouch including a fastener to permit a traveler to temporarily attach said pouch to the garment bag if the traveler does not want to use the collapsible garment bag carrier.

* * * * *